United States Patent [19]

Roop

[11] Patent Number: 4,552,001

[45] Date of Patent: Nov. 12, 1985

[54] HIGH SECURITY T-HANDLE ASSEMBLY

[75] Inventor: Stevie C. Roop, Dugspur, Va.

[73] Assignee: Medeco Security Locks, Inc., Salem, Va.

[21] Appl. No.: 558,473

[22] Filed: Dec. 6, 1983

[51] Int. Cl.[4] ..... E05B 63/00

[52] U.S. Cl. ..... 70/208; 70/417

[58] Field of Search ..... 70/208, 417, 381, 416

[56] References Cited

U.S. PATENT DOCUMENTS

| | | | |
|---|---|---|---|
| Re. 16,123 | 7/1925 | Schonwald | 70/417 |
| 3,089,329 | 5/1963 | Kerr | 70/135 |
| 3,089,330 | 5/1963 | Kerr | 70/140 |
| 3,111,833 | 11/1963 | Dettmer | 70/140 |
| 3,122,012 | 2/1964 | Christopher | 70/140 |
| 3,213,654 | 10/1965 | Dauenbaugh et al. | 70/208 |
| 3,222,899 | 12/1965 | Bodoh et al. | 70/140 |
| 3,234,765 | 2/1966 | Kerr | 70/208 |
| 3,285,043 | 11/1966 | Dauenbaugh et al. | 70/208 |
| 3,299,078 | 1/1967 | Spencer | 70/208 |
| 3,302,434 | 2/1967 | Dauenbaugh et al. | 70/208 |
| 3,438,227 | 4/1969 | Wolniak | 70/208 |
| 3,550,412 | 12/1970 | Pitel et al. | 70/461 |
| 3,738,134 | 6/1973 | Hall | 70/86 |
| 4,132,092 | 1/1979 | Steinbach | 70/208 |

*Primary Examiner*—Robert L. Wolfe

*Attorney, Agent, or Firm*—Bernard, Rothwell & Brown

[57] ABSTRACT

A pop-out T-handle assembly of the type containing a lock cylinder having high security features which defy forced entry is disclosed. A cylinder front handle and cylinder/extension housing are assembled around the cylinder lock and rigidly secured for protection against pulling the lock. The face of the cylinder lock is preferably protected by a freely rotating cylinder protector plate to protect against drilling into the cylinder lock. A locator tab and slot arrangement assures alignment of the cylinder lock bolt and a corresponding opening in the T-handle housing, as well as restricts lateral movement of the cylinder front handle within the T-handle housing to protect against prying. A T-handle clutch arrangement of a generally square configuration provides extensive bearing surface to absorb torque and prevent wear. An auxiliary locking mechanism for added protection against pulling the inner cylinder of the lock in the event that the cylinder protector plate is defeated or a method is devised to either pull or pry the cylinder front handle.

9 Claims, 14 Drawing Figures

FIG. 10
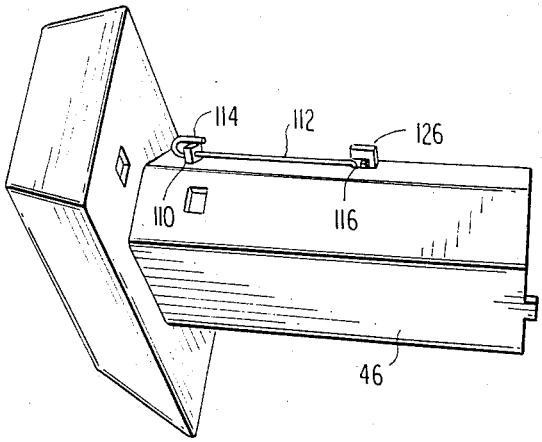
FIG. 11
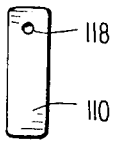
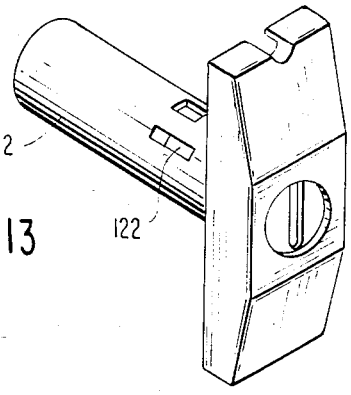
FIG. 13
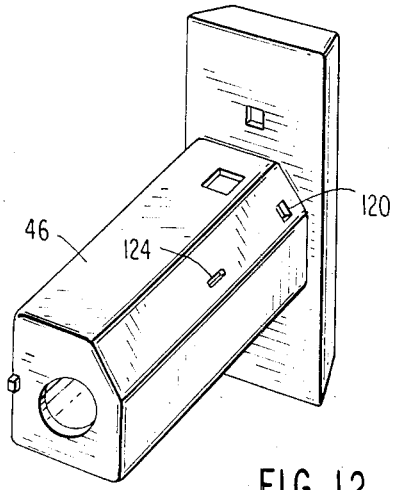
FIG. 12
FIG. 14
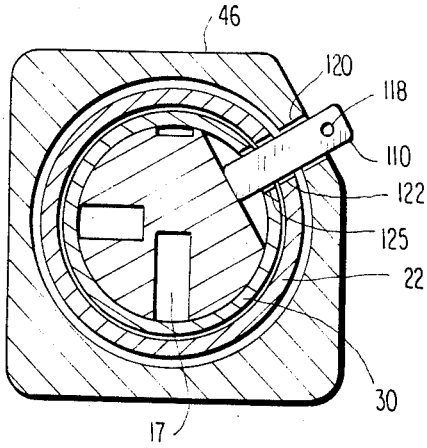

HIGH SECURITY T-HANDLE ASSEMBLY

BACKGROUND OF THE INVENTION

1. Field of the Invention

This invention relates to improvements in T-handle assemblies and particularly to a high security T-handle assembly having features to defy forced entry.

2. Description of the Background Art

T-handle assemblies are commonly used to control access in the vending machine and related arts. More specifically, a large number of box-like or self-contained units require high security locks. Typical are currency changers, soft drink or food vending machines, mass transit collection systems, bicycle storage modules, external utility boxes, and the like. It is well known to provide such machines with standard T-handle assemblies with locks. In fact T-handle assemblies are so well known that there are dimensional standards set forth by the NAMA (National Automatic Merchandising Association) and ASTM (American Society of Testing Materials). Typically, T-handle assemblies which contain cylinder locks operate by a key which causes a lock bolt to release a nested handle portion of the T-handle assembly, and usually such portion pops out when the lock is unlocked to allow the handle to be turned. Turning of the handle portion operates a mechanism to open a door or provide other access as is well known in the art.

Typical prior art T-handle assemblies with cylinder locks are disclosed in the following U.S. Pat. Nos. 3,089,329, 3,089,300, 3,111,833, 3,122,012, 3,213,654, 3,222,899, 3,234,765, 3,285,043, 3,299,678, 3,302,434, 3,550,412, 4,132,092.

Because of the valuable goods which need to be protected, e.g., currency and currency changers, coins and currency in vending machines, and transit fare card machines for examples, the need for security is high. However, most known T-handle assemblies can be defeated by drilling, prying, wrenching, and other forms of physical attack to obtain forced entry. There thus remains a need in the art for an improved high security T-handle assembly having features to defy forced entry.

SUMMARY OF THE INVENTION

In accordance with the present invention, a high security pop-out T-handle assembly of the type containing a lock cylinder comprises a cylinder front handle containing a passage therethrough for key access to the lock cylinder. A cylinder/extension housing of elongated hollow shape is provided having connection means on one end of the housing to mate with connection means on the cylinder front handle, the housing including a passageway through its wall for passage of a lock cylinder bolt from the lock cylinder accommodated in the housing. A means is provided for securely and rigidly connecting the cylinder front handle and a cylinder/extension housing in their assembled position. An extension rod having a head within and a body extending linearly outwardly of an end of the cylinder-/extension housing which is opposite the cylinder front handle is provided, as is a mechanical positively-engaging clutch means connecting the housing and the extension rod to allow the extension rod to be rotated when the lock cylinder is unlocked and the cylinder front handle pops out. The T-handle fits into a T-handle housing having a generally cup-shaped head configured to closely accommodate the cylinder front handle, and further having a hollow shank to accommodate the cylinder/extension housing. The hollow shank of the T-handle housing has a wall configuration to receive a lock cylinder bolt extendable from a lock cylinder to lock the T-handle assembly. A compression spring is positioned between the end of the shank of the T-handle housing and the end of the cylinder/extension housing, the spring being normally compressed to force the cylinder front handle outwardly when the lock cylinder is unlocked.

BRIEF DESCRIPTION OF THE DRAWINGS

FIG. 10 is an isometric elevational view of the T-handle housing and auxiliary locking mechanism of the T-handle assembly shown in FIG. 1.

FIG. 11 is an elevational view of the detached locking pin of the auxiliary locking mechanism shown in FIG. 11.

FIG. 12 is an isometric elevational view of the T-handle housing shown in FIG. 10 with the auxiliary locking mechanism removed.

FIG. 13 is an isometric elevational view of the connected cylinder front handle and cylinder/extension housing shown in FIG. 2 detached from the balance of the T-handle assembly showing the corresponding opening in the cylinder/extension housing for accommodation of the locking pin of the auxiliary locking mechanism shown in FIG. 10.

FIG. 14 is a sectional view of the T-handle assembly, taken at line 14—14 of FIG. 2, and showing the auxiliary locking mechanism.

DESCRIPTION OF THE PREFERRED EMBODIMENT

This invention relates to a high security pop-out T-handle assembly of the type containing a lock cylinder for use with vending cabinets, money-changing machines and the like. With reference to the drawings, a preferred embodiment of the invention will be described.

Figure 1:
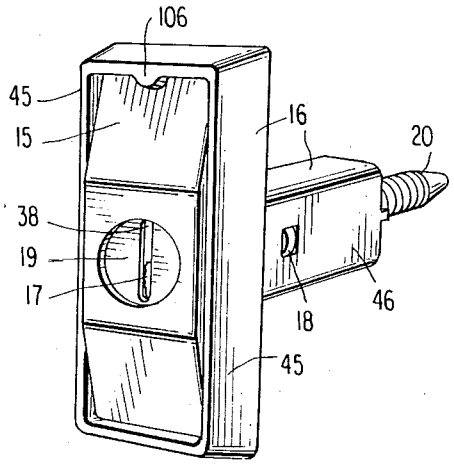
FIG. 1 is an isometric elevational view of a locked T-handle assembly embodying the present invention.

FIG. 1 is an isometric view of a complete closed T-handle assembly showing a generally rectangular cylinder front handle 15, which houses a cylinder protector plate 19. A handle housing 16 accommodates lock bolt 18 and extension rod 20.

Figure 2:
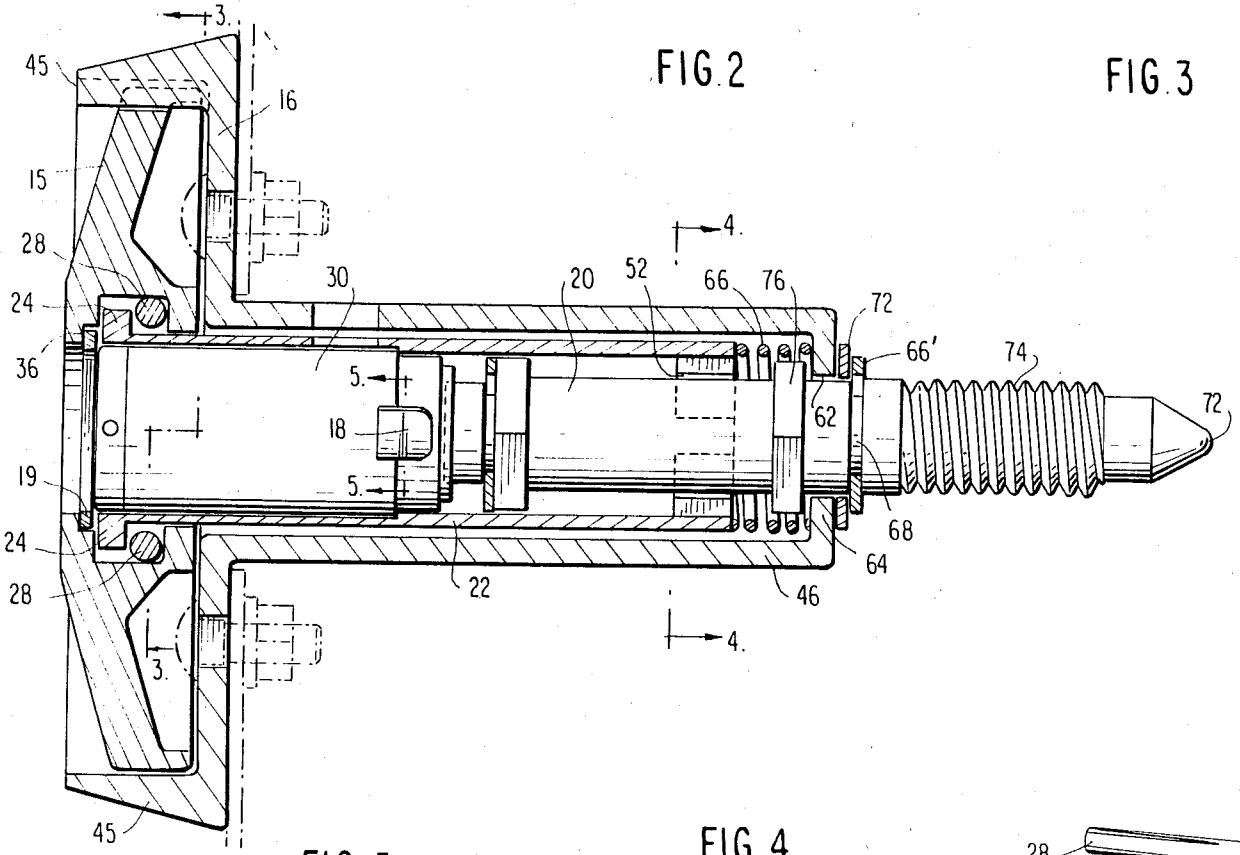
FIG. 2 is a vertical cross sectional view of the T-handle assembly shown in FIG. 1.
Figure 4:
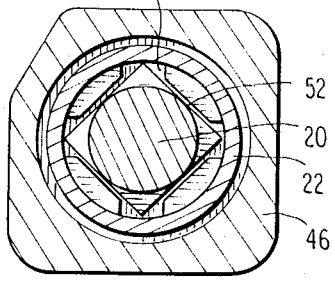
FIG. 4 is a sectional view of the T-handle assembly, taken at line 4—4 of FIG. 2.
Figure 5:
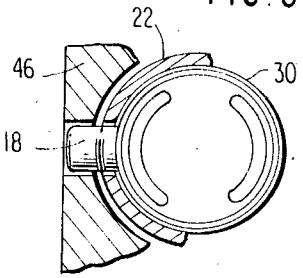
FIG. 5 is a sectional view of the T-handle assembly, taken at line 5—5 of FIG. 2.

As shown in FIG. 2, the cylinder front handle 15 is attached to a cylinder/extension housing 22, which together fit snugly within the handle housing 16 in the locked position. The cylinder front handle 15 is selectively detachable from the cylinder/extension housing 22 to permit loading of the contents of the cylinder/extension housing 22 and resist pulling the lock when assembled.

Figure 3:
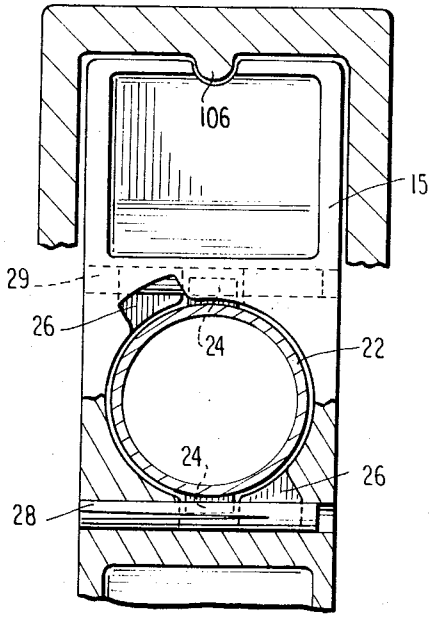
FIG. 3 is an enlarged sectional view of the T-handle assembly, taken at line 3—3 of FIG. 2.
Figure 6:
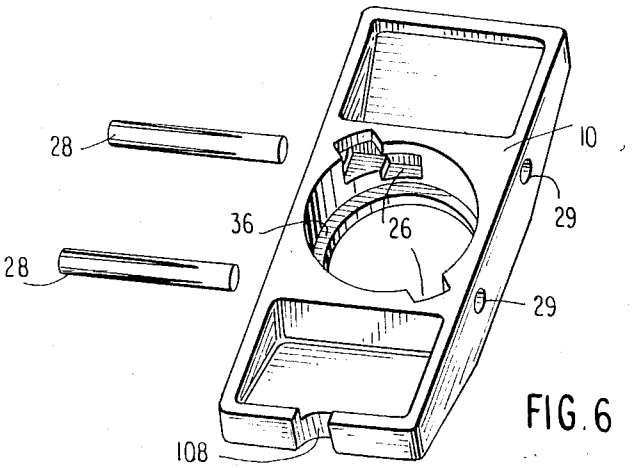
FIG. 6 is an isometric elevational view of the cylinder front handle detached from the T-handle assembly of FIG. 2, with drivable metal pins.

The cylinder front handle 15 is selectively firmly but detachably secured to the cylinder/extension housing 22. Referring to FIG. 2, FIG. 3, and FIG. 6, a preferred means of attaching the cylinder/extension housing 22 to the cylinder front handle 15 utilizes one or more, preferably two, flanges 24 which protrude from the cylinder-/extension housing 22 and fit into a complementary bayonet-type slots 26 located in the cylinder front handle 15. The flanges 24 are preferably firmly held in position within the bayonet-type slots 26 by one or more, preferably two, drivable metal pins 28 which extend through complementary transverse openings 29 in the cylinder front handle 15, passing through the slots 26 and thereby contacting the flanges 24 and thus firmly holding the flanges 24 rigidly within the slots 26. The pins 28 are preferably constructed of stainless steel for strength and durability, and may be selectively driven into or out of the transverse openings 29 if access is desired to the contents of the cylinder/extension housing 22. When the T-handle assembly is in the locked position, access to the pins 28 is obstructed by the handle housing 16, thereby defying removal of the pins 28. Other suitable means may be utilized to firmly attach the cylinder/extension housing 22 to the cylinder front handle 15, such as by threads on mating portions of both components (not shown).

Referring to FIG. 1, FIG. 2, FIG. 6, and FIG. 9, an annular interstice is provided within the cylinder front handle 15 wherein the circular cylinder protector plate 19 is positioned and may freely rotate to defy drilling. The interstice is preferably provided by positioning the bayonet-type slots 26 such that when the flanges 24 at the end of the cylinder/extension housing 22 are firmly attached within the slots 26, sufficient space remains between the flanges 24 and the inner face 36 of the cylinder front handle 15 wherein the cylinder protector plate 19 may be positioned and freely rotate. The cylinder protector plate 19 is preferably constructed of hardened steel to further defy drilling.

Figure 9:
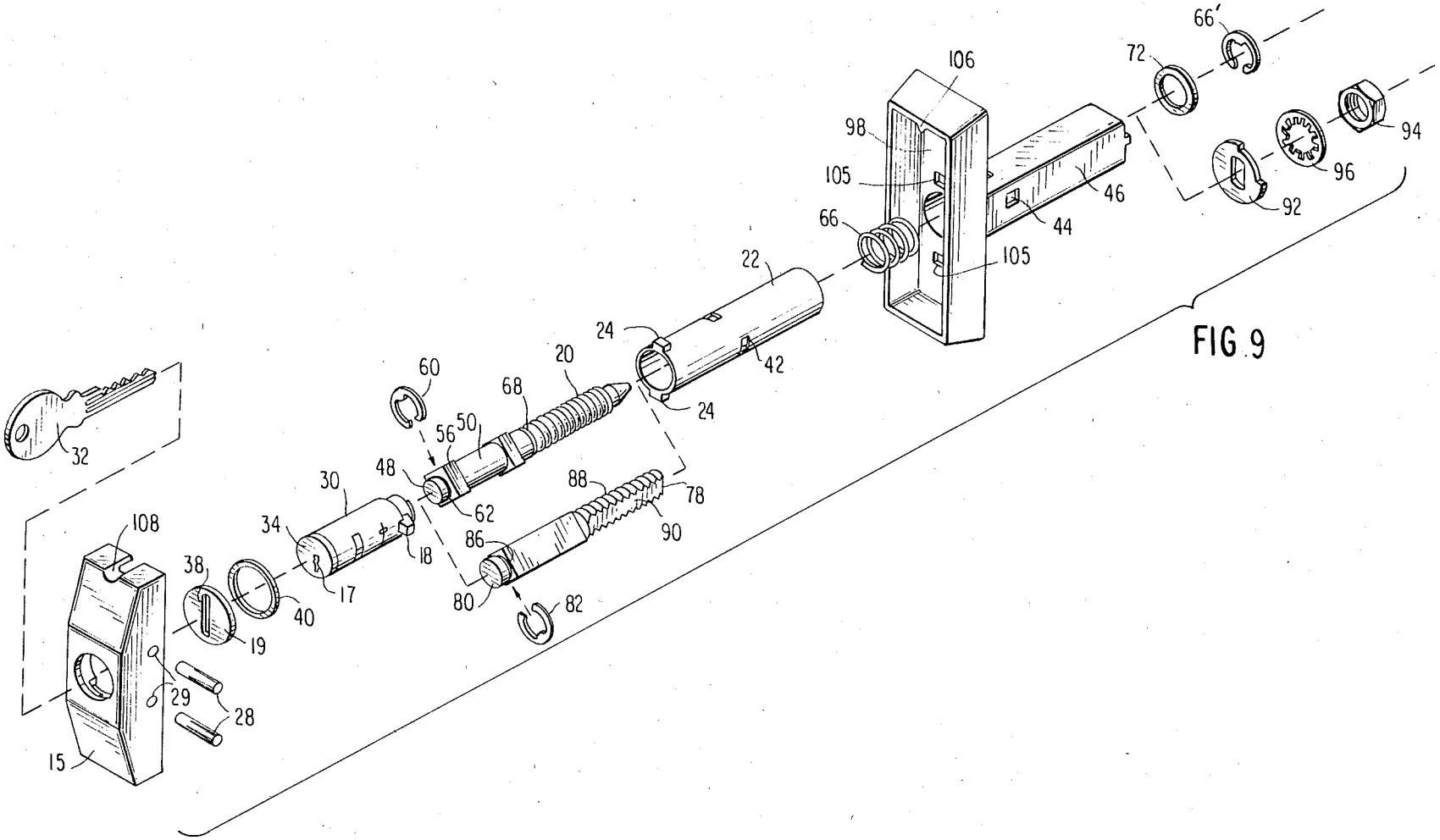
FIG. 9 is an exploded perspective view of the T-handle assembly shown in FIG. 1.

The cylinder front handle 15 and cylinder/extension housing 22 together house a cylinder lock 30 having a keyway 17, the cylinder protector plate 19, and the extension rod 20. As shown in FIG. 1, FIG. 2, and FIG. 9, the cylinder lock 30 has a lock bolt 18 at the side of the cylinder lock 30. The cylinder lock 30 is maintained in position within the cylinder/extension housing 22 in both the locked and unlocked position by means of the lock bolt 18 protruding into a complementary opening 42 in the side of the cylinder/extension housing 22. The cylinder lock is preferably but not necessarily a high security cylinder of the type manufactured by Medeco Security Locks, Inc. of Salem, Virginia.

A key 32, when inserted into the cylinder lock keyhole 17, controls the lock mechanism (not shown) which operates to selectively move the lock bolt 18 into or out of a complementary opening 44 in the side of the hollow shank 46 of the handle housing 16 in order to lock or unlock the T-handle relative to the handle housing 16.

As shown in FIG. 9, the cylinder protector plate 19 has an opening 38 through which a key 32 may be inserted into the keyway 17 of the cylinder lock 30 from outside the cylinder front handle 15. The opening 38 in the cylinder protector plate 19 is preferably in the shape of a slot when a flat key lock is used (as illustrated), to minimize access to the cylinder lock 30 from the outside. A circular opening is preferred when a circular key lock is used (not illustrated). One or more spacing washers 40 may optionally be placed between the cylinder protector plate 19 and the cylinder lock 30 to properly fit a particular cylinder lock 30 relative to the cylinder protector plate 19.

Figure 7:
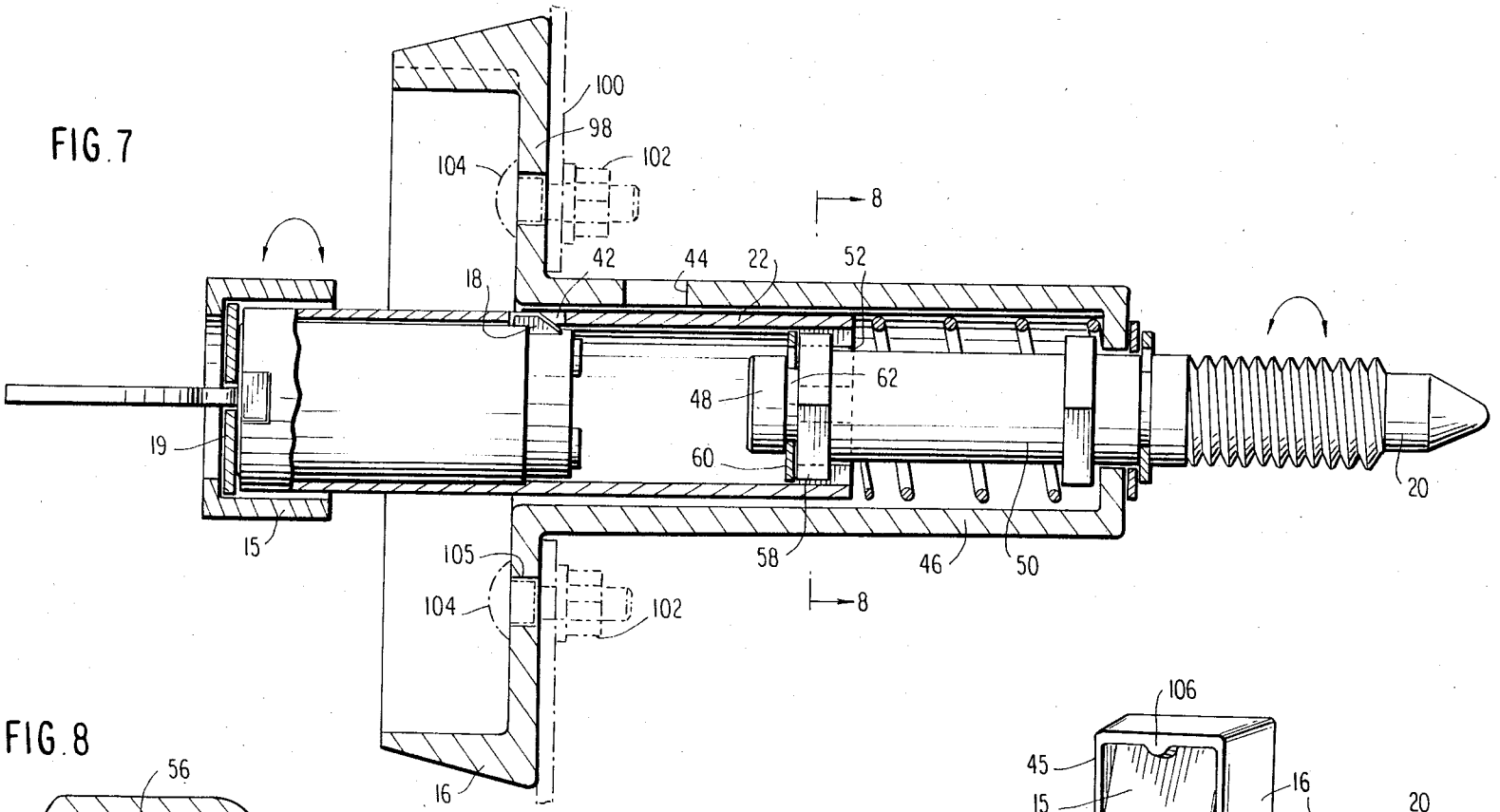
FIG. 7 is a vertical cross sectional view of an unlocked T-handle assembly shown in FIG. 2.
Figure 8:
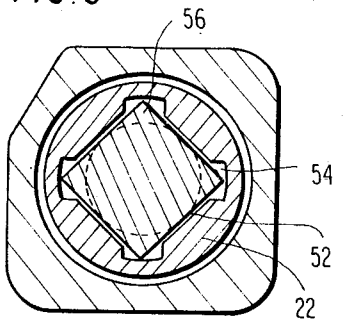
FIG. 8 is a sectional view of the T-handle assembly, taken at line 8—8 of FIG. 7.

Referring now to FIG. 7 or FIG. 9, the extension rod 20 has a head 48 within the cylinder/extension housing 22 and a body 50 extending linearly outwardly through an opening 52 in an end of the cylinder/extension housing 22 opposite the cylinder front handle 15. As shown in FIG. 7 and FIG. 8, the cylinder/extension housing 22 and the extension rod 20 are provided with a mechanical positively engaging clutch means, which when engaged, connects the cylinder/extension housing 22 and the extension rod 20 to allow the extension rod 20 to be rotated when the lock cylinder 30 is unlocked and the cylinder front handle 15 pops out of the T-handle housing 16. The clutch means preferably consists of slots 54 in the opening 52 of the cylinder/extension housing 22 which mate with corresponding teeth 56 adjacent the head 48 of the extension rod 20. When the teeth 56 mate with the slots 54, the extension rod 20 may be rotated by turning the cylinder/extension housing 22 by means of the cylinder front handle 15. It is particularly preferred that the teeth 56 are in the form of a generally square section 58 of the extension rod 20 adjacent to its head 48, with a complementary slot configuration formed at the opening 52 of the cylinder/extension housing 22, see FIG. 8. The generally square shape of the clutch provides extensive bearing surface to absorb torque when the extension rod 20 is turned, providing for extended life of the clutch with minimal wear.

Referring to FIG. 7 and FIG. 9, the head 48 of the extension rod 20 is preferably maintained within the cylinder/extension housing 22 by suitable means such as a C-shaped retaining ring 60. The C-shaped retaining ring 60 fits into a groove 62 cut into the extension rod 20 between the teeth 56 and the end of the head 48 of the extension rod 20. The C-shaped retaining ring 60 prevents passage of the head 48 of the extension rod 20 outside of the cylinder/extension housing 22 by contacting the inside edge of the slot configuration at the opening 52 of the cylinder/extension housing 22.

Referring now to FIG. 2, the T-handle, comprising the connected cylinder front handle 15 and the cylinder/extension housing 22 with their contents, fits snugly within the T-handle housing 16 in the locked position. The T-handle housing 16 has an elongated rectangular generally cup-shaped head 45 configured to closely accommodate the cylinder front handle 15 when locked, thereby restricting access to the cylinder front handle 15 by prying devices from the outside. The T-handle housing 16 also has a hollow shank 46 to accommodate the cylinder/extension housing 22. The portion of the extension rod 20 extending outwardly of the cylinder/extension housing 22 further extends linearly through a portion of the hollow shank 46, before extending through an opening 62 in the end of the hollow shank 46 opposite the cylinder front handle 15, and linearly outwardly of the end of the hollow shank 46.

the T-handle is "popped out" of the T-handle housing 22 by suitable means when the cylinder lock 30 is unlocked. This is preferably accomplished by a coil compression spring 66 situated within the hollow shank 46 between a spring support flange 64 and an end 65 of the cylinder/extension housing 22 opposite the cylinder front handle 15. The spring support flange 64 surrounds the opening 62 in the hollow shank 46 through which the extension rod 20 extends. The coil spring 66 is compressed when the connected cylinder front handle 15 and the cylinder/extension housing 22 are locked within the T-handle housing 16. Upon unlocking the cylinder lock 30, the coil spring 66 extends and forces the connected cylinder/extension housing 22 and the cylinder front handle 15 partially out of the T-handle housing 16.

Referring to FIG. 2 and FIG. 9, when a screw-type extension rod as illustrated in FIG. 2 is used, the connected cylinder/extension housing 22 and cylinder front handle 15 are held in place longitudinally by any suitable means such as by contact between a flat washer 70 and a second C-shaped retaining ring 66' which fits into a groove 68 located on a portion of the extension rod 20 extending outside of the T-handle housing 16. A rod retainer 76 located on a portion 56 of the extension rod 20 within the T-handle housing 16 adjacent to the spring support 64, also assists in maintaining the extension rod 20 substantially stationary in a longitudinal direction while allowing necessary rotation to operate the lock mechanism controlled by the extension rod 20. The rod retainer 76 restricts linear movement of the extension rod 20 beyond the spring support flange 64 thereby avoiding damage to extension rod 20. Referring to FIG. 8, the rod retainer 76 preferably has teeth of the same configuration as the teeth 56 adjacent to the head 48 of the extension rod 20, thus allowing free passage of the rod retainer 76 through the opening 52 in the end of the cylinder/extension housing 22 when assembling the lock.

The screw-type extension rod 20 has a tip 72 and threads 74 located between the tip 72 and the second retaining ring 66'. The threads 74 correspond to mating threads (not shown) located within the body of the cabinet to be locked. The screw-type extension rod 20 is preferably constructed of hardened steel for strength and durability.

Alternatively, the present invention may be utilized with a cam-type (quarter-turn) extension rod 78 as shown in FIG. 9. Referring to FIG. 8 and FIG. 9, the cam-type extension rod 78 has teeth 84 which mate with corresponding slots 54 in opening 52 at the end of the cylinder/extension housing 22. The cam-type extension rod 78 has a head 80 which is maintained within the cylinder/extension housing 22 by suitable means such as a C-shaped retaining ring 82. The C-shaped retaining ring 82 fits into a slot 86 adjacent to the teeth 84 and located between the head 80 of the cam-type extension rod 78 and the teeth 84.

Referring to FIG. 9, the teeth 84 preferably extend linearly along the cam-type extension rod 78 between the C-shaped retaining ring 82 and a point within the T-handle housing 16 adjacent to the spring support 64. Contact between the teeth 84 and the spring support 64 prevents movement of the teeth 64 through the opening 62 in the spring support 64. The cam-type extension rod 78 has a threaded portion 88 with two parallel flat sides 90, the threaded portion 88 extending linearly outwardly of the T-handle housing 16 through an opening 62 in the spring support 64. The teeth 84 are preferably maintained in a position adjacent to the spring support 64 by suitable means such as a 90° stop washer 92 adjacent to and outside of the spring support 64. The 90° stop washer 92 is held in place by a hex nut 94. Between the hex nut 94 and the stop washer 92 is located an internal tooth lockwasher 96.

The T-handle lock of the present invention is mounted in a door of a cabinet to be locked, as is well known in the art. Referring to FIG. 7 and FIG. 9, a back base face 98 of the T-handle housing 16 is typically mounted flush against an external surface 100 of a cabinet door. The hollow shank 46 of the T-handle housing 16 extends within the cabinet door through an opening in the surface 100 of the door. The face 98 of the T-handle housing 16 is attached to the surface 100 of the cabinet door by nuts 102 attached to bolts 104 extending through corresponding openings 105 in the housing face 98 and through the surface 100 of the cabinet door. The bolts 102 and nuts 104 are preferably constructed of hardened steel for strength and durability.

Referring to FIG. 1, FIG. 2, FIG. 3, and FIG. 9, a locator tab 106 is preferably situated on the inner surface of the cup-shaped head of the T-handle housing 16. The tab 106 corresponds to a locator slot 108 situated in the cylinder front handle 15. The tab 106 and slot 108 arrangement assures alignment of the lock cylinder bolt 18 with the corresponding opening 44 in the shank 46 of the T-handle housing 16. When the T-handle assembly is in the locked position, the tab 106 and slot 108 arrangement provides added protection against prying by resisting movement of the cylinder front handle 15 laterally within the cup-shaped head of the T-handle housing 16.

In one embodiment of the present invention, a second, auxiliary locking mechanism is provided for added security in the event that the main locking mechanism is defeated. Referring to FIG. 10 and FIG. 11, FIG. 12, FIG. 13, and FIG. 14, a preferred auxiliary locking mechanism comprises suitable means, such as locking in 110, which in conjunction with movement of the lock cylinder 30 is capable of selectively preventing or allowing movement of the cylinder/extension housing 22 relative to the handle housing 16. Suitable means of controlling the movement of the locking pin 110 are also provided, such as the wire locking pin spring 112. The wire spring 112 is connected to locking pin 110 by suitable means, such as by a hook 114 at one end of the wire spring 112 which extends through a corresponding eyelet 118 in the locking pin 110 outside of the T-handle housing 16. The wire spring 112 is connected to the outside of the T-handle housing 16 using suitable means such as by an anchor 116 at the end of the wire spring 112 opposite the hook 114. The anchor 116 rests in a slot 124 on the outside surface of the T-handle shank 46, and is held in place by suitable means such as a stake 126 driven into slot 124 over the anchor 116.

The locking pin 110 extends from outside the T-handle housing 16 through a corresponding opening 120 in the T-handle shank 46, then through a corresponding passageway 122 in the cylinder/extension housing 22, into a corresponding opening 125 in the lock cylinder 30. The end of the locking pin 110 opposite the wire spring 112 contacts the plug 126 of the lock cylinder 30, which when rotated cams the end of locking pin 110 outwardly to release the lock cylinder relative to the T-handle shank 22. When locked, the locking pin 110 provides a solid connection between the cylinder 30 and the handle housing 16, making it much more difficult to defeat the mechanism by pulling the cylinder 30.

The cylinder front handle 15, cylinder/extension housing 22 and T-handle housing 16 are preferably constructed of high strength cast stainless steel for strength and durability.

The high-security T-handle of the present invention possesses improvements over prior art T-handles which defy forced entry. The method of securely joining the cylinder front to the cylinder/extension housing enables back-loading of the cylinder lock into the cylinder/extension housing for protection against pulling of the lock. The freely rotating hardened cylinder protector plate protects against drilling into the cylinder lock.

The locator tab and slot arrangement assures alignment of the cylinder lock bolt and the corresponding opening in the T-handle housing. The locator tab and slot arrangement also restricts lateral movement of the cylinder front within the T-handle housing thus protecting against prying.

Additional features of the invention include a clutch arrangement of generally square configuration which provides a greater bearing surface to absorb torque, virtually eliminating wear problems. The auxiliary locking mechanism provides added protection against pulling the inner cylinder and destroying the bolt in the event that the hardened cylinder protector plate is defeated or a method is devised to either pull or pry the cylinder front.

What is claimed is:

1. A high security pop-out T-handle assembly of the type containing a lock cylinder, the assembly comprising:

(a) a cylinder front handle containing a passage therethrough for key access to the lock cylinder, the handle having an inwardly facing flange at the outer face of the passage, (b) a separate cylinder/extension housing of elongated hollow shape having connection means on one end of the housing to mate with connection means on the cylinder front handle, the housing including a passageway through its wall for passage of a lock cylinder bolt from the lock cylinder accommodated in the housing, (c) removable mechanical connection means for securely and rigidly connecting the cylinder front handle and cylinder/extension housing in their assembled position, and to allow disassembly thereof, the assembled position of the cylinder front handle and cylinder/extension housing leaving an annular interstice behind the flange of the cylinder front handle, (d) a cylinder protector plate positioned and freely rotatably in the interstice to resist drilling and pulling of the lock cylinder, (e) an extension rod having a head within and a body extending linearly outwardly of an end of the cylinder/extension housing which is opposite the cylinder front handle, (f) mechanical positively-engaging clutch means connecting the housing and the extension rod to allow the extension rod to be rotated when the lock cylinder is unlocked and the cylinder front handle pops out, (g) a T-handle housing having a generally cup-shaped head configured to closely accommodate the cylinder front handle, and to cover the mechanical connection means when the cylinder front handle is positioned therein, the T-handle housing further having a hollow shank to accommodate the cylinder/extension housing, the shank having a wall configuration to receive a lock cylinder bolt extendable from a lock cylinder to lock the T-handle assembly, and (h) a compression spring positioned between the end of the shank of the T-handle housing and the end of the cylinder/extension housing, the spring being normally compressed to force the cylinder front handle outwardly when the lock cylinder is unlocked.

2. A high security pop-out T-handle assembly of the type containing a lock cylinder, the assembly comprising:

(a) a cylinder front handle containing a passage therethrough for key access to the lock cylinder, (b) a cylinder/extension housing of elongated hollow shape having connection means on one end of the housing to mate with connection means on the cylinder front handle, the housing including a passageway through its wall for passage of a lock cylinder bolt from the lock cylinder accommodated in the housing, (c) removable mechanical connection means for securely and rigidly connecting the cylinder front handle and cylinder/extension housing in their assembled position, including bayonet connection means on the end of the housing assembled to the cylinder front handle and on the cylinder front handle, (d) an extension rod having a head within and a body extending linearly outwardly of an end of the cylinder/extension housing which is opposite the cylinder front handle, (e) mechanical positively-engaging clutch means connecting the housing and the extension rod to allow the extension rod to be rotated when the lock cylinder is unlocked and the cylinder front handle pops out, (f) a T-handle housing having a generally cup-shaped head configured to closely accommodate the cylinder front handle, and further having a hollow shank to accommodate the cylinder/extension housing, the shank having a wall configuration to receive a lock cylinder bolt extendable from a lock cylinder to lock the T-handle assembly, and (g) a compression spring positioned between the end of the shank of the T-handle housing and the end of the cylinder/extension housing, the spring being normally compressed to force the cylinder front handle outwardly when the lock cylinder is unlocked.

3. A high security pop-out T-handle assembly of the type containing a lock cylinder, the assembly comprising:

(a) a cylinder front handle containing a passage therethrough for key access to the lock cylinder, (b) a cylinder/extension housing of elongated hollow shape having connection means on one end of the housing to mate with connection means on the cylinder front handle, the housing including a passageway through its wall for passage of a lock cylinder bolt from the lock cylinder accommodated in the housing, (c) removable mechanical connection means for securely and rigidly connecting the cylinder front handle and cylinder/extension housing in their assembled position, including at least one drivable pin extending through the cylinder front handle and cooperating with the cylinder/extension housing to prevent movement thereof after the cylinder front handle and cylinder/extension housing are assembled, (d) an extension rod having a head within and a body extending linearly outwardly on an end of the cylinder/extension housing which is opposite the cylinder front handle, (e) mechanical positively-engaging clutch means connecting the housing and the extension rod to allow the extension rod to be rotated when the lock cylinder is unlocked and the cylinder front handle pops out, (f) a T-handle housing having a generally cup-shaped head configured to closely accommodate the cylinder front handle, and further having a hollow shank to accommodate the cylinder/extension housing, the shank having a wall configuration to receive a lock cylinder bolt extendable from a lock cylinder to lock the T-handle assembly, and (g) a compression spring positioned between the end of the shank of the T-handle housing and the end of the cylinder/extension housing, the spring being normally compressed to force the cylinder front handle outwardly when the lock cylinder is unlocked.

4. A high security pop-out T-handle assembly of the type containing a lock cylinder, the assembly comprising:

(a) a cylinder front handle contining a passage therethrough for key access to the lock cylinder, (b) a cylinder/extension housing of elongated hollow shape having connection means on one end of the housing to mate with connection means on the cylinder front handle, the housing including a passageway through its wall for passage of a lock cylinder bolt from the lock cylinder accommodated in the housing, (c) removable mechanical connection means for securely and rigidly connecting the cylinder front handle and cylinder/extension housing in their assembled position, including means for securely connecting the cylinder front handle and the cylinder/extension housing comprising a bayonet connection means on both the cylinder front handle and cylinder/extension housing of complementary nature to allow assembly and further comprises at least one drivable pin extending through the cylinder front handle to prevent the bayonet connection means from being uncoupled, (d) an etension rod having a head within and a body extending linearly outwardly of an end of the cylinder/extension housing which is opposite the cylinder front handle, (e) mechanical positively-engaging clutch means connecting the housing and the extension rod to allow the extension rod to be rotated when the lock cylinder is unlocked and the cylinder front handle pops out, (f) a T-handle housing having a generally cup-shaped head configured to closely accommodate the cylinder front handle, and further having a hollow shank to accommodate the cylinder/extension housing, the shank having a wall configuration to receive a lock cylinder bolt extendable from a lock cylinder to lock the T-handle assembly, and (g) a compression spring positioned between the end of the shank of the T-handle housing and the end of the cylinder/extension housing, the spring being normally compressed to force the cylinder front handle outwardly when the lock cylinder is unlocked.

5. A high security pop-out T-handle assembly as defined in claim 1 further comprising; a cooperating elongated locator slot, and matching elongated tab means on the cylinder front handle and T-handle housing head to assure alignment of a lock cylinder bolt with only one side of the T-handle shank wall configuration and to provide added protection against prying when the cylinder front handle is within the T-handle housing head.

6. A high security pop-out T-handle assembly as defined in claim 1 further comprising an auxiliary locking means extending through the T-handle housing, the cylinder/extension housing and into the lock cylinder, and thereby providing added protection against pulling the bolt.

7. A high security pop-out T-handle assembly of the type containing a lock cylinder, the assembly comprising:

(a) a cylinder front handle containing a passage therethrough for key access to the lock cylinder, (b) a cylinder/extension housing of elongated hollow shape having connection means on one end of the housing to mate with connection means on the cylinder front handle, the housing including a passageway through its wall for passage of a lock cylinder bolt from the lock cylinder accommodated in the housing, (c) means for securely and rigidly connecting the cylinder front handle and cylinder/extension housing in their assembled position, (d) an extension rod having a head within and a body extending linearly outwardly of an end of the cylinder/extension housing which is opposite the cylinder front handle, (e) mechanical positively-engaging clutch means connecting the housing and the extension rod to allow the extension rod to be rotated when the lock cylinder is unlocked and the cylinder front handle pops out, (f) a T-handle housing having a generally cup-shaped head configured to closely accommodate the cylinder front handle, and further having a hollow shank to accommodate the cylinder/extension housing, the shank having a wall configuration to receive a lock cylinder bolt extendable from a lock cylinder to lock the T-handle assembly, and (g) a compression spring positioned between the end of the shank of the T-handle housing and the end of the cylinder/extension housing, the spring being normally compressed to force the cylinder front handle outwardly when the lock cylinder is unlocked, and (h) an auxiliary locking means providing added protection against pulling the bolt, the auxiliary locking means comprising a spring member having one end attached to the shank housing and another biasing a locking pin toward the center of the lock cylinder, the locking pin extending through a passageway in the T-handle shank and cylinder/extension housing into the lock cylinder so that the end of the pin contacts a plug of the lock cylinder and may be rotated thereby to selectively release or hold the lock cylinder to the T-handle shank.

8. A high security pop-out T-handle assembly of the type containing a lock cylinder, the assembly comprising:

(a) a cylinder front handle containing a passage therethrough for key access to the lock cylinder, (b) a cylinder/extension housing of elongated hollow shape having connection means on one end of the housing to mate with connection means on the cylinder front handle, the housing including a passageway through its wall for passage of a lock cylinder bolt from the lock cylinder accommodated in the housing, (c) means for securely and rigidly connecting the cylinder front handle and cylinder/extension housing in their assembled position, (d) an extension rod having a head within and a body extending linearly outwardly of an end of the cylinder/extension housing which is opposite the cylinder front handle, (e) mechanical positively-engaging clutch means connecting the housing and the extension rod to allow the extension rod to be rotated when the lock cylinder is unlocked and the cylinder front handle pops-out, (f) a T-handle housing having a generally cup-shaped head configured to closely accommodate the cylinder front handle, and further having a hollow shank to accommodate the cylinder/extension housing, the shank having a wall configuration to receive a lock cylinder bolt extendable from a lock cylinder to lock the T-handle assembly, and (g) a compression spring positioned between the end of the shank of the T-handle housing and the end of the cylinder/extension housing, the spring being normally compressed to force the cylinder front handle outwardly when the lock cylinder is unlocked, (h) a hardened protector plate positioned to be freely rotatable between a back side of the cylinder front handle and a front face of the cylinder plug, the protector plate having a passage therethrough to accommodate a lock cylinder, (i) a spacing washer positioned behind the hardened protector plate so as to accommodate different size lock cylinders, (j) an auxiliary locking means providing added protection against pulling the bolt, the auxiliary locking means comprising a spring member having one end attached to the shank housing and another biasing a locking pin toward the center of the lock cylinder, the locking pin extending through a passageway in the T-handle shank and cylinder/extension housing into the lock cylinder so that the end of the pin contacts a plug of the lock cylinder and may be rotated thereby to selectively release or hold the lock cylinder to the T-handle shank.

9. A high security pop-out T-handle assembly comprising:

(a) a cylinder front handle containing a passageway therethrough for key access and having an inturned flange on the entrance of the passageway, (b) a cylinder/extension housing of elongated tubular shape having an outer end and an inner end and having an opening in a wall thereof for a locking bolt, (c) a lock cylinder positioned in the cylinder/extension housing, the lock cylinder being key-operated, having a rotatable plug, and a bolt extendable through the housing wall, the lock cylinder being insertable into the cylinder/extension housing only from the outer end thereof, (d) means for mechanically assembling and rigidly connecting the cylinder front handle to the outer end of the cylinder/extension housing so that the key access passageway in the cylinder front handle is in alignment with the plug in the lock cylinder within the cylinder/etension housing, (e) a hardened protector plate having an opening therethrough for key access, the plate being freely rotatable and positioned between the flange on the entrance of the passageway in the cylinder front handle and the cylinder lock, (f) a threaded extension rod having one end with teeth of a clutch member extending into the inner end of the cylinder/extension housing, (g) complementary positively-engaging clutch member within the inner end of the cylinder/extension housing for engagement with the clutch configuration on the threaded extension rod, (h) a T-handle housing having a cup-shaped head configured to closely accommodate the cylinder front handle and to cover the means for connecting the handle and the cylinder/extension housing, and a shank shaped to accommodate the cylinder/extension housing, the shank having a wall configuration to receive the lock cylinder bolt to lock the T-handle, and (i) spring means positioned in the shank of the T-handle for biasing the cylinder front handle and cylinder/extension housing outwardly.

* * * * *

UNITED STATES PATENT AND TRADEMARK OFFICE

CERTIFICATE OF CORRECTION

PATENT NO. : 4,552,001

DATED : November 12, 1985

INVENTOR(S) : Stevie C. Roop

It is certified that error appears in the above-identified patent and that said Letters Patent is hereby corrected as shown below:

In column 4, line 65, at the beginning of the sentence, delete the first occurrence of "the" and substitute therefor --The--;

In column 9, line 49, claim 4, subpart (d), delete "etension" and substitute therefor --extension--.

Signed and Sealed this

*Eighth* Day of *July 1986*

[SEAL]

*Attest:*

DONALD J. QUIGG

*Attesting Officer*

*Commissioner of Patents and Trademarks*